United States Patent [19]

Whitmer, II

[11] Patent Number: 4,723,418

[45] Date of Patent: Feb. 9, 1988

[54] SELF-CONTAINED PORTABLE REFRIGERATION UNIT

[76] Inventor: Robert L. Whitmer, II, P.O. Box 1433, South Bend, Ind. 46624-1433

[21] Appl. No.: 42,796

[22] Filed: Apr. 27, 1987

[51] Int. Cl.[4] ..... F25D 19/00

[52] U.S. Cl. ..... 62/298; 62/372; 62/449; 62/457

[58] Field of Search ..... 62/371, 372, 457, 298, 62/448, 449, 450

[56] References Cited

U.S. PATENT DOCUMENTS

| | | | |
|---|---|---|---|
| 2,509,779 | 5/1950 | Morrison | 62/298 X |
| 2,521,064 | 9/1950 | Kleist | 62/298 X |
| 2,671,603 | 3/1954 | Bauer | 62/449 X |
| 3,131,551 | 5/1964 | Ross | 62/298 |
| 3,262,283 | 7/1966 | Taylor | 62/372 |

*Primary Examiner*—Lloyd L. King

*Attorney, Agent, or Firm*—Thomas J. Dodd

[57] ABSTRACT

A portable refrigeration unit adapted for cold storage of human remains. The unit includes a storage container formed of multiple insulated walls detachably interconnected for rapid assembly and disassembly. A refrigeration unit is connected to the container for maintaining the temperature in the container below indoor ambient temperature.

5 Claims, 4 Drawing Figures

SELF-CONTAINED PORTABLE REFRIGERATION UNIT

SUMMARY OF THE INVENTION

This invention relates to portable refrigerators and will have special but not limited application to portable refrigeration units for cold storing of human remains.

The need for suitable refrigeration units is a growing concern for privately owned mortuaries. Due to recent changes in embalming regulations and the increase in direct cremations, delays are often promulgated in the disposition of remains. Under the current system, bodies often must be transported to public morgues for temporary refrigeration at an additional cost to the mortuary and survivors of the deceased. Also, the high cost of the refrigeration units on the market makes them impractical for purchase by most privately owned mortuaries.

This invention provides for a portable refrigeration unit which may be used to store human remains for extended periods when delays occur in disposition. The unit is constructed of multiple panels of insulated wood or metal with the panels being detachably connected to allow rapid assembly time and disassembly time. A cooling unit is connected to one of the end panels and provides the cool air required for refrigeration.

Accordingly, it is an object of this invention to provide for a novel portable refrigeration unit.

Another object of this invention is to provide a portable refrigeration unit which is specially adapted for cold storage of human remains.

Another object of this invention is to provide for a portable refrigeration unit which is easy to assemble and disassemble.

Still another object of this invention is to provide for a portable refrigeration unit which is efficient and economical for use in private funeral homes, hospitals, nursing homes and other related facilities.

Other objects of this invention will become apparent upon a reading of the following description.

BRIEF DESCRIPTION OF THE DRAWINGS

A preferred embodiment has been depicted for illustrative purposes only wherein.

DESCRIPTION OF THE PREFERRED EMBODIMENT

Figures 1, 3:
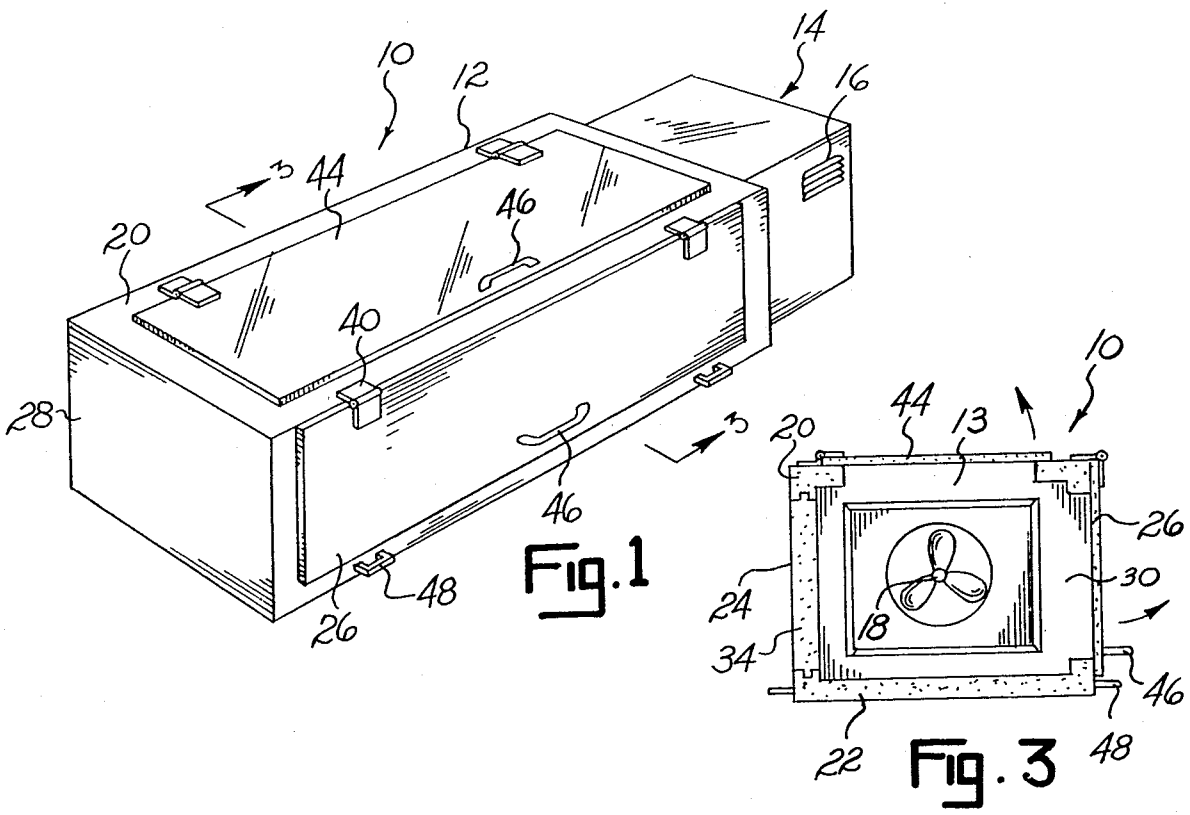
FIG. 1 is a perspective view of the portable refrigeration unit.
FIG. 3 is a cross-sectional view of the unit taken along line 3—3 of FIG. 1.

The preferred embodiment herein described is not intended to be exhaustive or to limit the invention to the precise form disclosed. It is chosen and described to explain the principles of the invention and its application and practical use whereby others skilled in the art may utilize the invention.

Referring now to the drawings, the reference numeral 10 refers generally to the portable refrigeration unit of this invention. Refrigeration unit 10 is generally adaptable for use in cold storage of human remains, but will find use in a variety of refrigeration functions.

The unit 10 includes a box-like storage container 12 and an attached refrigeration member 14. Refrigeration member 14 is depicted as a conventional condensing unit 16 connected to a blower 18 but may consist of any of a number of suitable units used for this purpose. Container 12 is formed of a top wall 20, bottom wall 22, side walls 24 and 26, and end walls 28 and 30. Each wall 20–30 may be formed of any suitable framing material such as wood or steel (or other metal) and will include a quantity of thermally insulative material 34 such as open cell polystyrene or the like.

Figure 2:
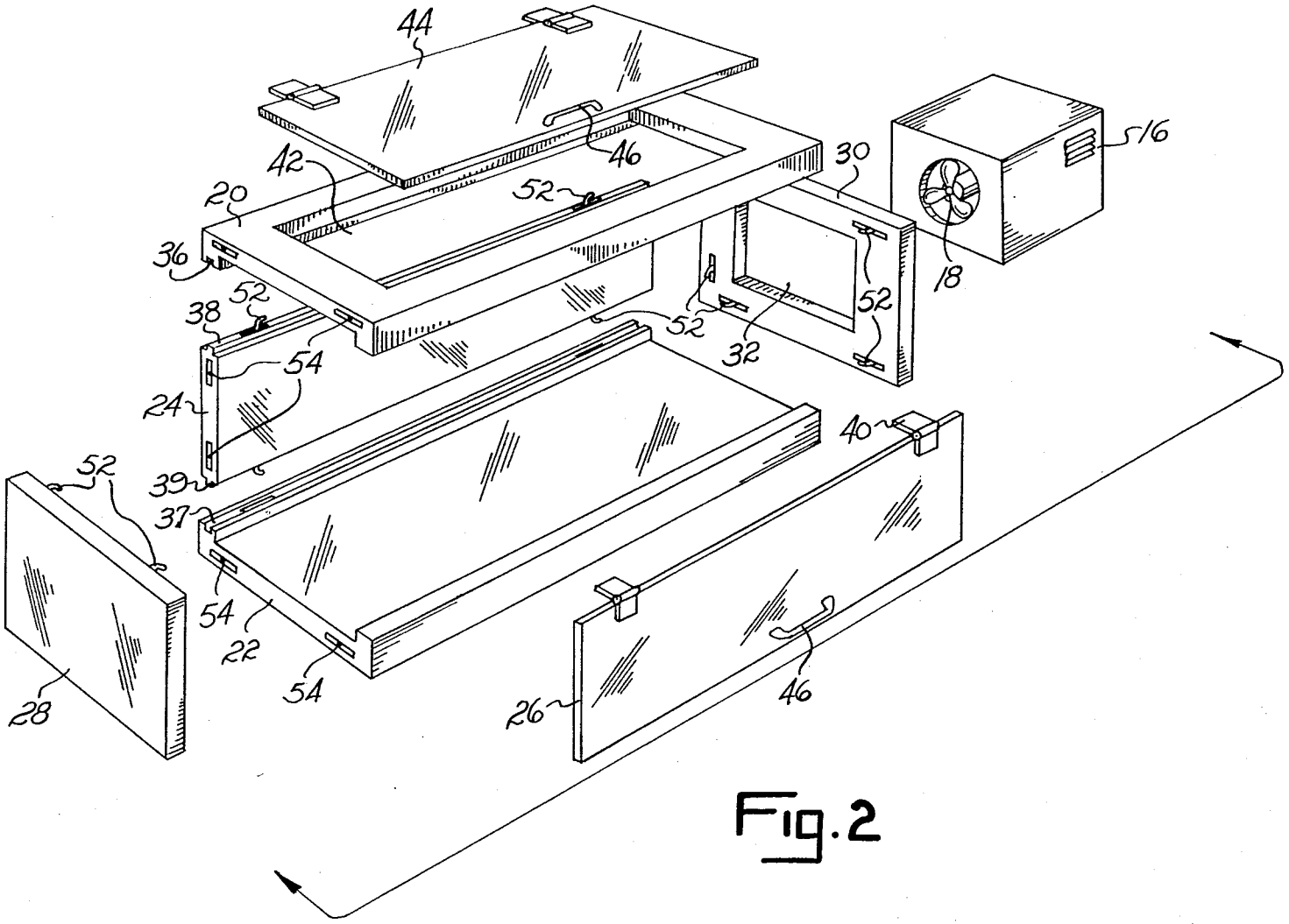
FIG. 2 is an exploded view thereof.

As shown in FIG. 2, top wall 20 and bottom wall 22 are of substantially U-shaped configuration and include a notched channel 36,37 respectively, running longitudinally along the rear portion of the respective wall. Side wall 24 includes top and bottom longitudinal ribs 38,39 which fit complementally within respective channels 36,37. Front side wall 26 may be connected to one or more hinges 40 as shown in FIGS. 1 and 3 and function as a door member for container 12. Top wall 20 may also include an opening 42 covered by a hinged door 44 to provide access to the interior of container 12. Each door 44 (as well as hinged side wall 26) may include a handle 46. Container 12 may include handles 48 and/or rollers (not shown) to assist in transportation from place to place.

Figure 4:
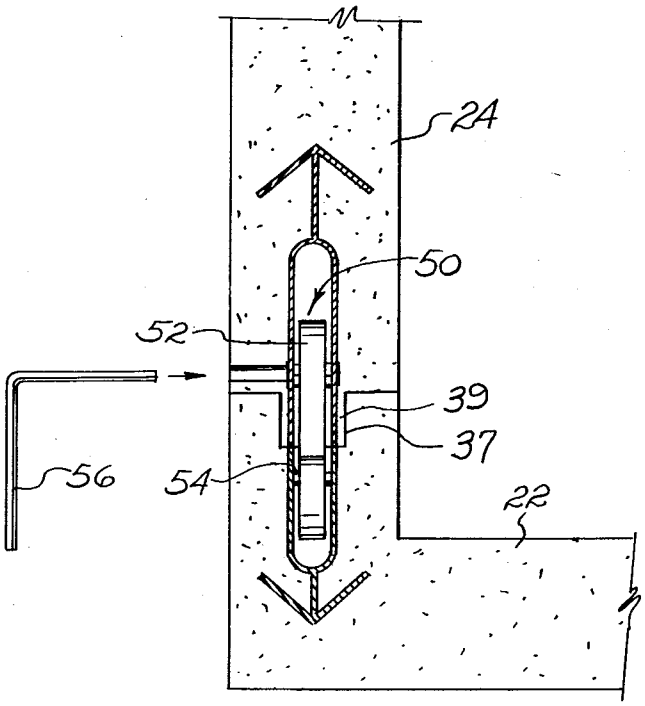
FIG. 4 is a fragmentary cross-sectional view of a container fastener in the locked position.

End walls 28,30 may be connected to top wall 20 and rear side wall 24 by cam type fasteners 50 shown in FIGS. 2 and 4. Side wall 24 is also connected to top wall 20 and bottom wall 22 by fasteners 50. Each fastener 50 shown includes a latch hook 52 and peg 54 and is produced by Bangor Cooler Company, Hartford, Michigan. It is understood that any conventional fastener adapted for use in polystyrene or other formed insulation may be used to secure walls 20–30 of container 12. End wall 30 preferably includes an opening 32 therethrough to allow cold air from refrigeration member 14 to communicate with the interior 13 of container 12.

Container 12 is assembled by aligning top wall 20, bottom wall 22 and rear side wall 24 through rib-channel combination 36–39. After aligning end walls 28 and with the ends of the container, fasteners 50 are turned by a conventional tool (such as an Allen type wrench 56) to allow hooks 52 to secure the end walls and side walls to the top and bottom walls. Any desired hinged doors (26 or 44) are then attached through their hinges 40. It should be noted that if no front door is desired, front side wall 26 will be identical in construction to rear side wall 24 in the rib-groove arrangement. If no hinged top door 44 is desired, opening 42 is eliminated and top wall 20 formed as a solid unit.

It is to be understood that the invention is not limited by the above-given illustrative details but may be modified within.

I claim:

1. In a portable refrigeration unit which includes a storage container, and refrigeration means associated with said storage container for maintaining the temperature within the storage container at a predetermined temperature, the improvement wherein said storage container includes a top wall and a bottom wall spaced by two side walls and two end walls to form a complete enclosure, said top wall and bottom wall detachably connected to said side walls and end walls , said end walls detachably connected to said side walls wherein said storage container has an operative orientation forming said enclosure and a storage orientation with the top, bottom, side and end walls disconnected to allow storage of the portable refrigeration unit.

2. The portable refrigeration unit of claim 1 wherein said refrigeration means is detachably connected to one of said side wall and end wall and includes a condensing unit and a blower.

3. The portable refrigeration unit of claim 1 wherein one of said storage container top wall and side wall is pivotally connected to an adjacent wall of said storage container whereby access is provided into said storage container.

4. The portable refrigeration unit of claim 1 and handle means associated with at least one of said storage container side walls for facilitating movement of said storage container when assembled.

5. The portable refrigeration unit of claim 1 wherein said storage container walls are formed of wood, insulative means positioned adjacent said walls for effecting efficient temperature maintenance within said storage container.

* * * * *